US006182474B1

(12) United States Patent
Bruelemans et al.

(10) Patent No.: US 6,182,474 B1
(45) Date of Patent: Feb. 6, 2001

(54) METHOD OF MANUFACTURING A KNITTED ARTICLE, ON A FLAT BED KNITTING MACHINE

(75) Inventors: Karel Bruelemans, Thiescourt; Michel Gelrubin, Neuilly sur Seine, both of (FR)

(73) Assignee: Terrot, Paris (FR)

( * ) Notice: Under 35 U.S.C. 154(b), the term of this patent shall be extended for 0 days.

(21) Appl. No.: 09/329,751

(22) Filed: Jun. 10, 1999

(30) Foreign Application Priority Data

Jun. 15, 1998 (FR) ..... 98 07504

(51) Int. Cl.[7] ..... D04B 1/22; D04B 7/04; D04B 7/30

(52) U.S. Cl. ..... 66/64; 66/170

(58) Field of Search ..... 66/64, 170

(56) References Cited

U.S. PATENT DOCUMENTS 4,351,068 * 9/1982 Taylor ..... 2/409
4,463,581 * 8/1984 Vitols et al. ..... 66/87
5,692,399 12/1997 Takahashi et al. .
5,873,266 * 2/1999 Kosugi et al. ..... 66/64

FOREIGN PATENT DOCUMENTS 39 37 406 5/1991 (DE) .
0 063 518 10/1982 (EP) .
2 779 747 * 6/1998 (FR) .
386448 1/1933 (GB) .

* cited by examiner

*Primary Examiner*—Andy Falik
(74) *Attorney, Agent, or Firm*—Schweitzer Cornman Gross & Bondell LLP

(57) ABSTRACT

A method of manufacturing a knitted article such as a beret. The method is for an article knitted by means of a knitting machine having two rectilinear needle beds, including a front bed and a back bed, at least one of the two beds being capable of racking, the beds also being provided with respective needles enabling stitches to be transferred from one bed to the other. The article being knitted is processed until there remain on the beds only two edges to be assembled together. Those two edges are assembled together by knitting a chain-stitch seam directed towards the inside of the article.

8 Claims, 3 Drawing Sheets

METHOD OF MANUFACTURING A KNITTED ARTICLE, ON A FLAT BED KNITTING MACHINE

The present invention relates to a method of manufacturing a knitted article.

The invention relates more particularly but not exclusively to manufacturing a beret.

BACKGROUND OF THE INVENTION

A beret or an analogous article is knitted in conventional manned/by means of a knitting machine having two rectilinear or flat needle beds, a front bed and a back bed, at least one of the beds being capable of being racked, each of the beds also being provided with needles enabling stitches to be transferred from one bed to the other.

It is known to knit in successive rows of stitches on both beds until there remain thereon only two edges to be assembled together, and then to unite the edges after the article has been transported to a linking machine.

Proposals are made in French patent application FR-A-2 409 337 and in European patent application EP-A-0 063 518 to eliminate the use of a linking machine and of the associated labor by transferring each of the stitches constituting one of the edges from one of the beds to the other and then uniting the stitches by sewing using a special sewing device, but that has the drawback of complicating manufacture of the knitting machine.

OBJECTS AND SUMMARY OF THE INVENTION

The present invention seeks to facilitate the manufacture of a beret or the like.

The invention achieves this by means of a novel manufacturing method, of the type in which the article is knitted by means of a knitting machine having two rectilinear beds, comprising a front bed and a back bed, at least one of the beds being capable of being racked, each of said beds also being fitted with needles enabling stitches to be transferred from one bed to the other, the article being knitted until there remain on the beds only two edges that are to be assembled together, wherein said edges are assembled together by knitting a chain-stitch seam that is turned towards the inside of the article.

In a preferred implementation of the invention, the seam is knitted while racking only the back bed, only the front bed, or both the front and bed beds simultaneously until there remain only a few occupied needles on the beds, in such a manner that if the progress of the knitting of the seam is observed when all of the needles in the two beds are exactly in register, each stitch that has just been knitted on one of the beds is to be found, after being transferred to the other bed, offset by two needles in the seam knitting direction, the stitches being knitted alternately on one bed and then on the other.

In a particular implementation of the method of the invention, the seam is knitted by means of an assembly technique comprising the following steps, the two beds initially being in a position where they are offset by two needles.

Preferably, a knitting machine is used having knocking-over bits with incorporated springs.

Also preferably, the article is knitted in successive sectors of stitch height that is generally increasing from the center of the article towards its periphery.

The invention also provides a knitted article, in particular a beret, closed on itself by means of a chain-stitch seam that is directed towards the inside.

By means of the invention, the article can be knitted entirely on the knitting machine without any need to transfer the piece of knitting to a linking machine or to add a special sewing device to the knitting machine.

This provides a saving of labor and makes it possible to use a conventional knitting machine without any need to modify it by adding a sewing device.

BRIEF DESCRIPTION OF THE DRAWINGS

The invention will be better understood on reading the following detailed description of a non-limiting implementation of the invention, and on examining the accompanying drawings, in which.

MORE DETAILED DESCRIPTION

It is assumed in the description below that the article being knitted is a beret and that a conventional knitting machine is used, as described in European patent application EP-A-0 602 622, for example.

In general, this type of machine comprises two rectilinear needle beds, each having needles enabling stitches to be transferred from one bed to the other, and having knocking-over bits with incorporated springs, thus making it possible to exert gentle and regular tension on the thread.

All of the needles in a bed are identical.

The machine advantageously includes a presser in conventional manner.

FIGS. 1 to 15 show only the right end portion of the front and back beds 3 and 2, while FIGS. 16 to 23 show only the left end portions of said beds.

To knit a beret, both beds are used simultaneously, in conventional manner, until there remain only two edges to be assembled together.

Knitting is performed in successive sectors including stitch height that generally increases from the center of the beret towards the periphery so as to impart the desired volume thereto.

The invention relates more particularly to the manner in which the edges are assembled together.

Figure 1:
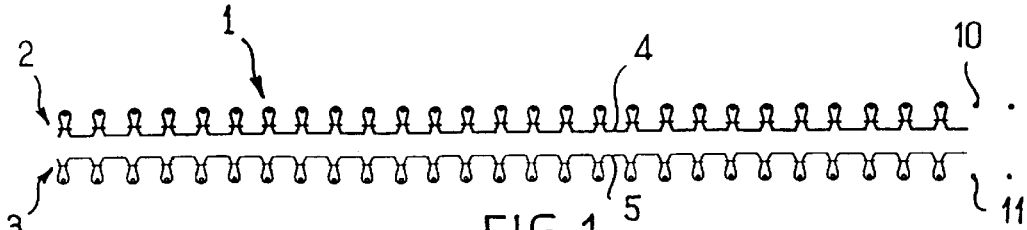
FIGS. 1 to 23 show the various steps of an implementation of the method of the invention.

FIG. 1 shows diagrammatically and in part only the back bed 2 and the front bed 3 of the machine 1. The cam-carrying carriage of the machine 1 is not shown in the figures, in order to clarify the drawings.

The front bed 3 has a row 5 of stitches held in the hooks of the needles, each needle 11 of the front bed 3 being represented by a dot in the drawings.

It is assumed that the last-but-one row 4 of stitches of the beret has just been knitted on the back bed 2, with each needle 10 of the back bed likewise being represented by a dot in the drawings.

The back bed 2 has been racked by half a pitch step so as to bring the needles of the front and back beds 3 and 2 exactly in register.

Figure 2:
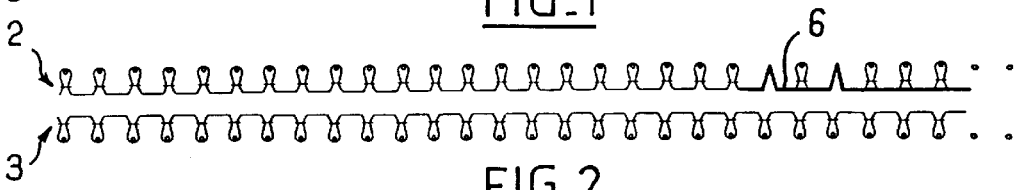
Figure 3:
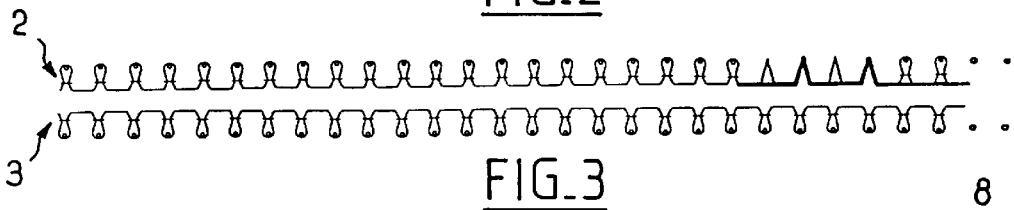

The following operation, shown in FIG. 2, consists in hooking the end of an assembly thread 6 on two needles of the back bed 2 during the go stroke of the cam-carrier carriage, and then on two adjacent other needles in the same bed during the return stroke of the cam-carrier carriage, as shown in FIG. 3.

Figure 4:
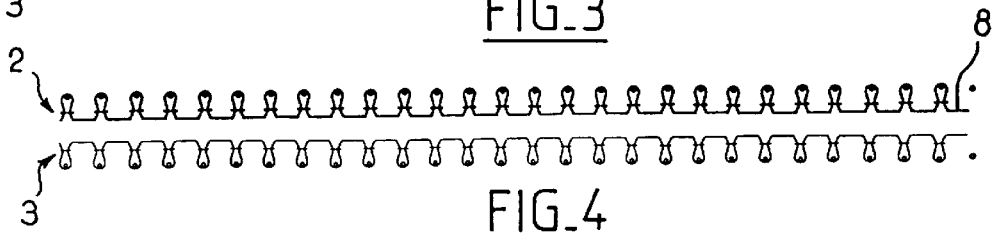

After the assembly thread 6 has been hooked, a row 8 of stitches is knitted on the back bed 2, as shown in FIG. 4.

The assembly thread used is preferably identical in characteristics to the thread used for knitting the article, but is distinct therefrom.

In a variant, it would be possible to use the same thread.

Figure 5:
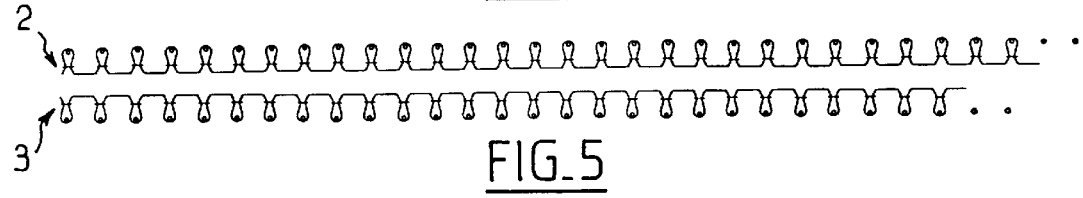

After the row 8 of stitches has been knitted, the back bed is racked two needles to the right, as shown in FIG. 5.

Figure 6:
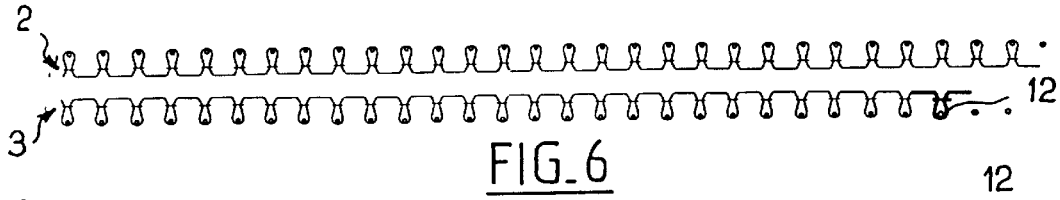
Figure 7:
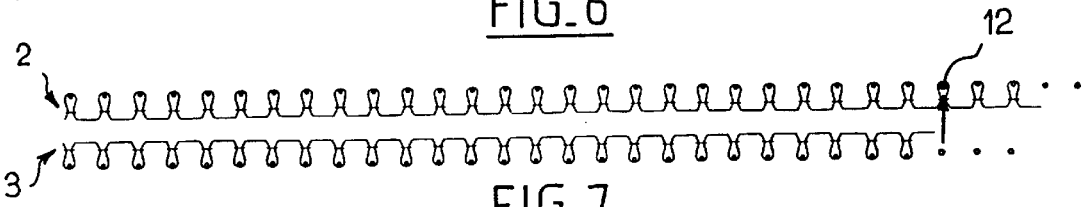

Thereafter, as shown in FIG. 6, the above-mentioned assembly thread is used to knit a stitch 12 on the selvedge needle of the front bed 3, and then as shown in FIG. 7, this stitch 12 is transferred to the needle facing it on the back bed 2.

Transferring a stitch from one bed to the other is an operation that is well known per se and it is performed by means of needles adapted to this operation.

This transfer operation serves to release the selvedge needle.

Figure 8:
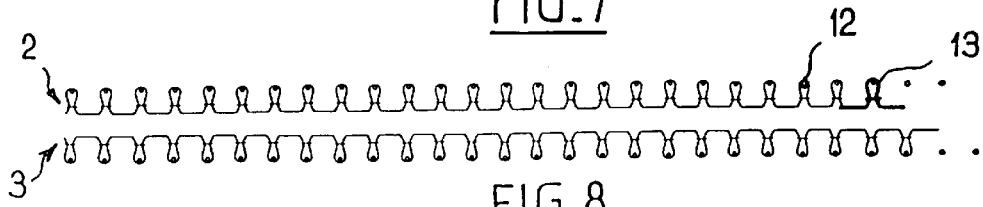

After the transfer operation, the back bed 2 is racked by four needles to the left as shown in FIG. 8, and then a stitch 13 is knitted on the selvedge needle of the back bed 2 by means of the assembly thread.

Figure 9:
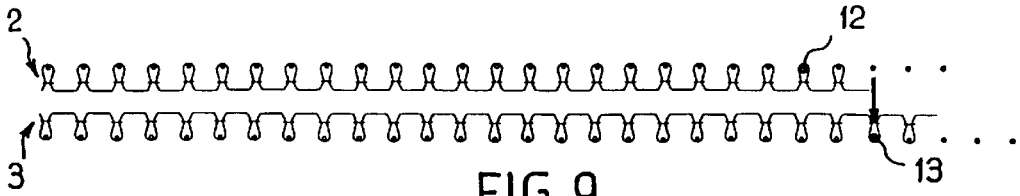
Figure 10:
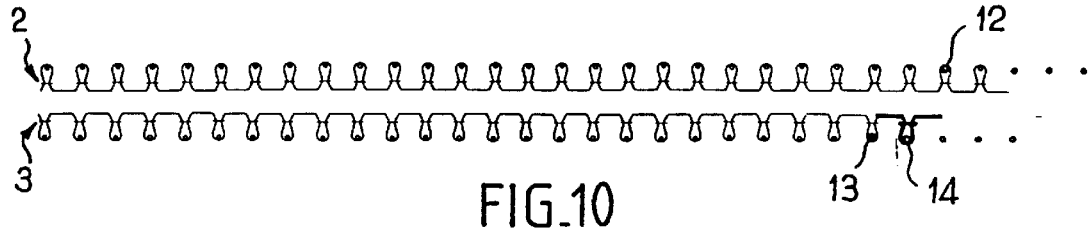

Thereafter, this stitch 13 is transferred to the front bed 3, as shown in FIG. 9, and then the back bed 2 is racked four needles to the right.

Figure 11:
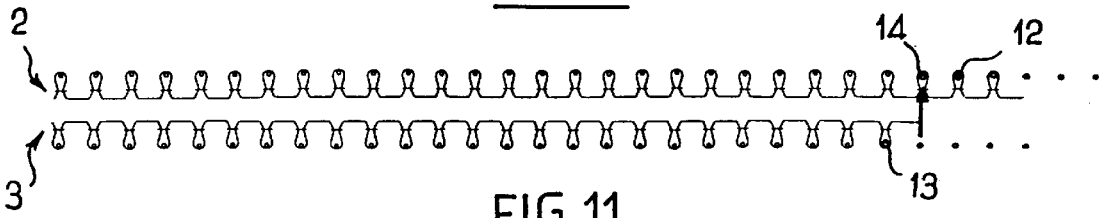

In the following step, a stitch 14 is knitted by means of the assembly thread on the selvedge needle of the front bed 3, and this stitch is transferred to the back bed, as shown in FIG. 11.

Figure 12:
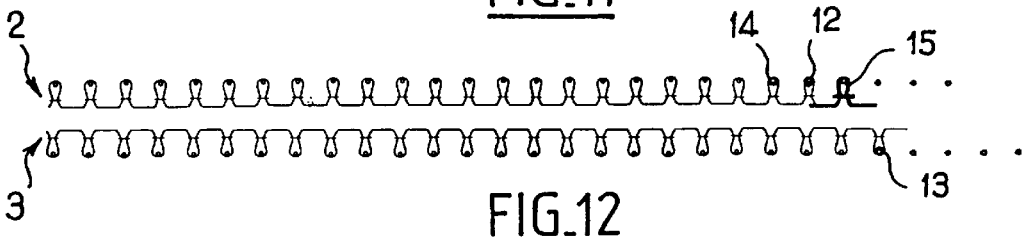

The back bed 2 is then racked again four needles to the left and the assembly thread is used to knit a stitch 15 on the selvedge needle of the back bed 2, as shown in FIG. 12.

Figure 13:
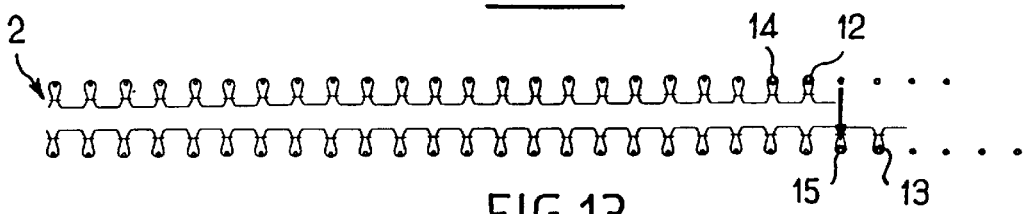

Thereafter, as shown in FIG. 13, this stitch 15 is transferred to the front bed 3, and then the back bed 2 is racked again four needles to the right.

Figure 14:
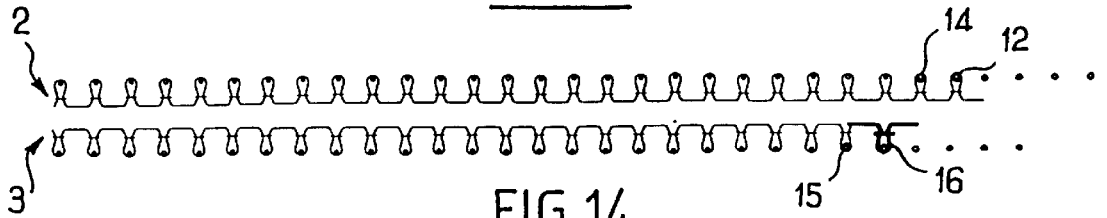

A stitch 16 is then knitted by means of the assembly thread on the selvedge needle of the front bed 3, as shown in FIG. 14.

Figure 15:
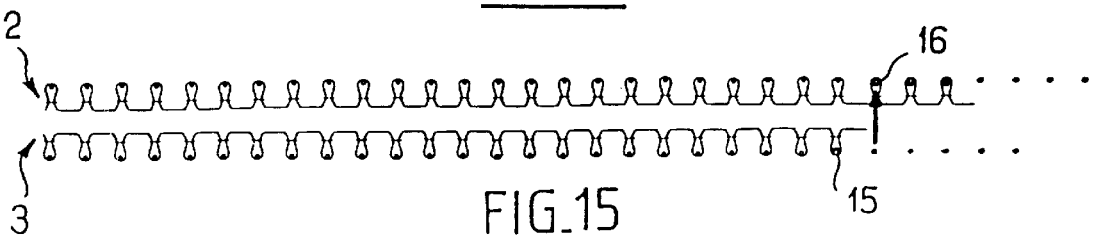

This stitch 16 is then transferred to the back bed 2, as shown in FIG. 15.

It will be understood that the steps corresponding to FIGS. 6 to 10 are repeated a certain number of times so as to release the needles of the front and back beds 3 and 2 progressively and knit a special structure also known as a chain-stitch seam.

It should also be observed that in the case of the present application the seam is particular since it is turned towards the inside of the article and therefore does not appear on the outside of the beret.

FIGS. 16 to 23 show the end of the operation of knitting the seam.

Figure 16:
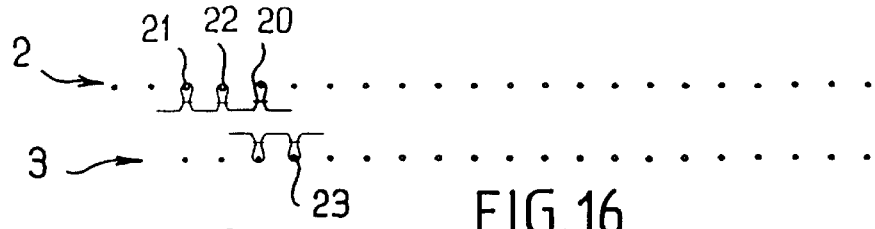

It is assumed that at the step corresponding to FIG. 16 a stitch 20 has just been knitted on the selvedge needle of the back bed.

The two stitches previously knitted on the front bed 3 and then transferred to the back bed 2 are referenced 21 and 22.

The selvedge needle of the front bed 3 has a stitch 23 previously knitted on the back bed 2 and then transferred to the front bed 3.

The back bed 2 has been racked two and a half needles to the left so that firstly the back bed projects two needles to the left, and secondly the needles of the front and back beds 3 and 2 are exactly in register.

There remain only two needles engaged with stitches on the front bed 3 and three needles engaged with stitches on the back bed 2.

Figure 17:
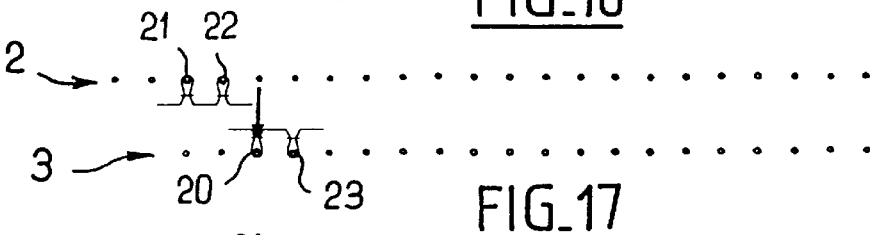

FIG. 17 shows the stitch 20 being transferred to the needle of the front bed 3 that is situated immediately to the left of the needle carrying the stitch 23.

Figure 18:
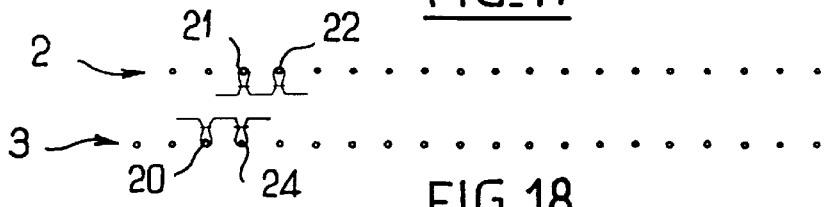

After this transfer operation, and as shown in FIG. 18, the back bed 2 is racked three needles to the right and a stitch 24 is knitted on the selvedge needle of the front bed 3.

Figure 19:
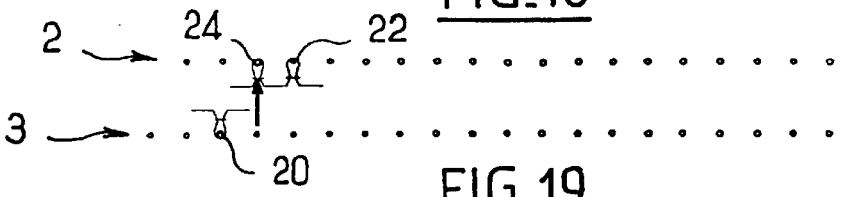

This stitch 24 is then transferred, as shown in FIG. 19, to the back bed 2.

Figure 20:
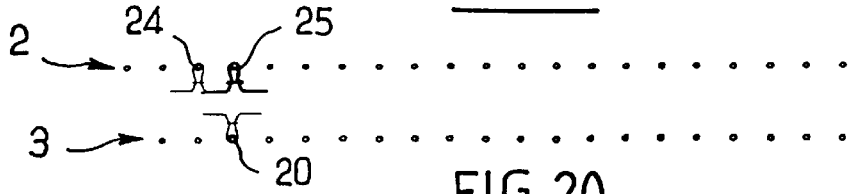
Figure 21:
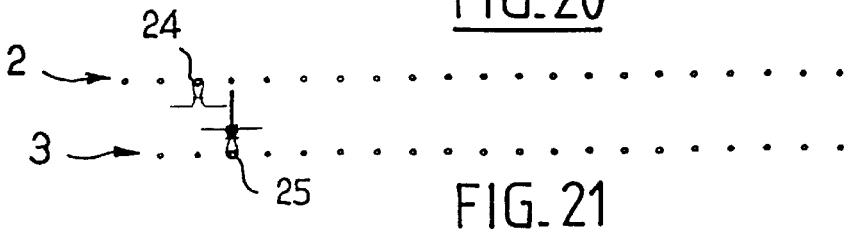

Thereafter, as shown in FIG. 20, a stitch 25 is knitted on the selvedge needle of the back bed 2 and is then transferred to the last occupied needle on the front bed 3, as shown in FIG. 21.

Figure 22:
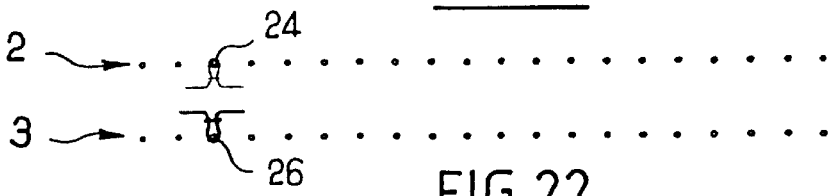
Figure 23:
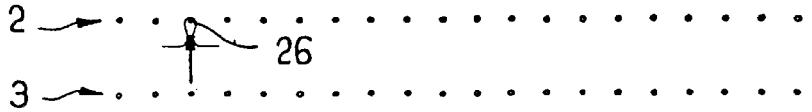

The front bed 2 is then racked one needle to the right, so that all the needles are exactly in register, and, as shown in FIG. 22, a stitch 26 is knitted on the last occupied needle of the front bed, which is then transferred, as shown in FIG. 23, to the back bed 2.

There then remains only one occupied needle on the machine.

The method can be continued either by knitting a new article or by removing the stitch 26 to fully release the beret that has just been knitted.

Naturally, the invention is applicable to any type of tubular knitting, and in particular to making hollow articles other than berets, for example a cap or a baraclava or any other knitted garment or article such as a furniture cover, for example.

In the example described, it is assumed that the article is knitted with a plain or jersey stitch, but naturally it would not go beyond the ambit of the present invention to knit using some other type of stitch.

In the implementation described, knitting is performed from right to left, but in a variant it is possible to implement the invention while knitting from left to right.

In the implementation described, a machine is used in which only the back bed is racked.

It would not go beyond the ambit of the invention to use a machine in which both the back bed and the front bed are racked in opposite directions, e.g. by two needles, to obtain a relative displacement of four needles between the two beds, or indeed in which only the front bed is racked.

What is claimed is:

1. A method of manufacturing a knitted article comprising the steps of (a) supplying thread to a knitting machine having two rectilinear beds, comprising a front bed and a back bed, at least one of the beds being capable of being racked, (b) operating such beds with fitted needles enabling stitches to be transferred from one bed to the other, (c) knitting the article until there remain on the beds only two edges that are to be assembled together, and (d) assembling said two edges by knitting a chain-stitch seam that is turned towards the inside of the article.

2. A method according to claim 1, further characterized in that (a) said seam is knitted while racking only the back bed, only the front bed, or both the front and back beds simultaneously until there remain only a few occupied needles on the beds, in a manner that when all of the needles in the two beds are in register, each stitch that has just been knitted on one of the beds is to be found, after being transferred to the other bed, offset by two needles in the seam knitting direction, the stitches being knitted alternately on one bed and then on the other.

3. A method according to claim 1, wherein the seam is knitted by means of an assembly technique comprising the following steps, the two beds initially being in a position where they are offset by two needles:

a) knitting a stitch on a selvedge needle of the front, respectively back, bed;

b) transferring said stitch to the back, respectively front, bed;

c) racking the back and/or front bed, passing through a position in which all of the needles of the two beds are exactly in register, such that the stitch transferred in this way is offset by four needles relative to the needle on which it was knitted;

d) knitting a stitch on a selvedge needle of the back, respectively front bed;

e) transferring said stitch to the front, respectively back bed; and f) racking the back and/or front bed, passing through a position in which all of the needles of the two beds are exactly in register, and displacing the bed(s) in the opposite direction to that of step c), such that the stitch transferred in this way is offset by four needles relative to the needle on which it was knitted;

and wherein steps a) to f) are repeated until there remain only two occupied needles on the front, respectively back bed.

4. A method according to claim 3, wherein, in steps c) and f), only one bed is racked by four needles.

5. A method according to claim 3, wherein, prior to step a), the following steps are performed:

an assembly thread is hooked onto at least one needle of one of the beds; and at least one row of stitches is knitted on said bed.

6. A method according to claim 3, wherein, once steps a) to f) have been performed until there remain only two occupied needles on the front, respectively back bed, the following steps are performed after step c):

knitting a stitch on the selvedge needle of the back, respectively front bed;

transferring said stitch onto the front, respectively back bed;

racking the back, respectively front bed by three needles;

knitting a stitch on the selvedge needle of the front, respectively back bed;

transferring said stitch onto the back, respectively front bed;

racking the back, respectively front bed by two needles;

knitting a stitch on the selvedge needle of the back, respectively front bed;

transferring said stitch onto the front, respectively back bed;

racking the back, respectively front bed by one needle;

knitting a stitch on the occupied needle of the front, respectively back bed; and transferring said stitch to the back, respectively front bed.

7. A method according to claim 1, a knitting machine having knocking-over bits with incorporated springs.

8. A method according to claim 1, wherein the article is knitted in successive sectors of stitch height that is generally increasing from the center of the article towards its periphery.

* * * * *